US005119421A

United States Patent [19]

Reime

[11] Patent Number: 5,119,421

[45] Date of Patent: Jun. 2, 1992

[54] STEREO SYSTEM CABINET WITH LOUDSPEAKER DOOR ASSEMBLY

[76] Inventor: Paul W. Reime, 13 Lindenwood Dr., Belleville, Ill. 62220

[21] Appl. No.: 547,782

[22] Filed: Jul. 3, 1990

[51] Int. Cl.[5] ..... H04R 5/00; H04R 1/02; H04R 25/00; A47B 81/06

[52] U.S. Cl. ..... 381/24; 381/88; 381/205; 181/199

[58] Field of Search ..... 381/24, 88, 159, 205; 181/199, 152

[56] References Cited

U.S. PATENT DOCUMENTS 2,547,447 9/1945 Boer ..... 381/24
2,923,370 10/1958 Capite ..... 381/24

FOREIGN PATENT DOCUMENTS 150298 9/1982 Japan ..... 381/24
894900 4/1962 United Kingdom ..... 381/24

OTHER PUBLICATIONS

Brady & Krisher, Swing out hinge connector, 6/60.

*Primary Examiner*—James L. Dwyer
*Assistant Examiner*—Jack Chiang
*Attorney, Agent, or Firm*—Cohn, Powell & Hind

[57] ABSTRACT

This stero system cabinet and loudspeaker door assembly (10) includes a cabinet body (12) having opposed sides and an open front portion, and a door assembly (14) including opposed mounting frames (30) pivotally connected to the side of the cabinet body (12) for movement about a first vertical pivot axis (38) and opposed loudspeaker panels (40) each pivotally connected to an associated mounting frame for movement about a second vertical pivot axis (50). The mounting frames are swingable about the first pivot axis between a closed position and an open position and the loudspeaker panels (40) are swingable about the second pivot axis so that in the closed position, with the loudspeaker panel facing outwardly, and the open position, with the loudspeaker panel facing outwardly each loudspeaker panel is laterally shifted a distance substantially equal to twice the horizontal spacing between the pivot axes.

12 Claims, 3 Drawing Sheets

FIG. 2.
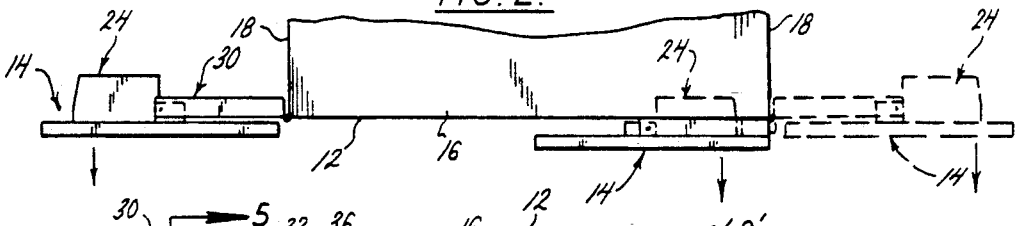
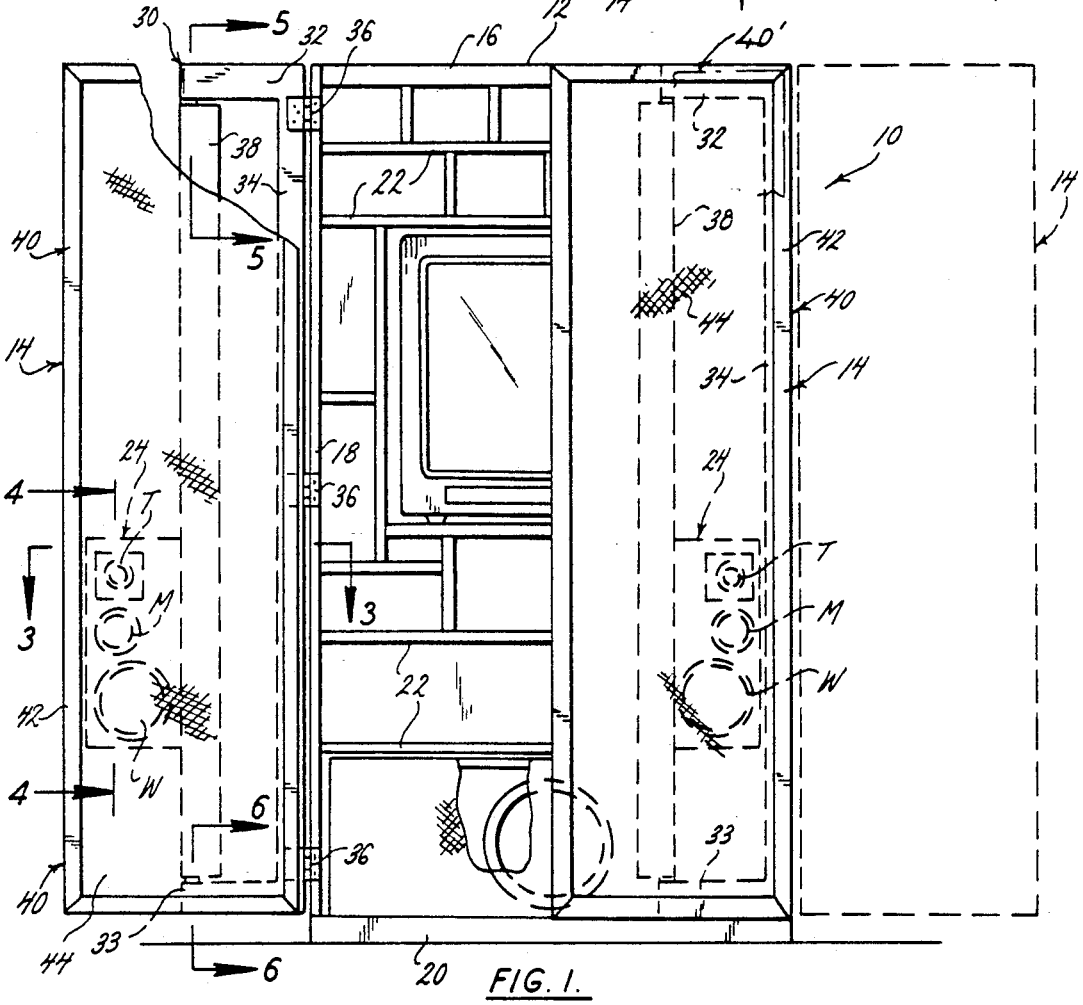
FIG. 1.
FIG. 3.
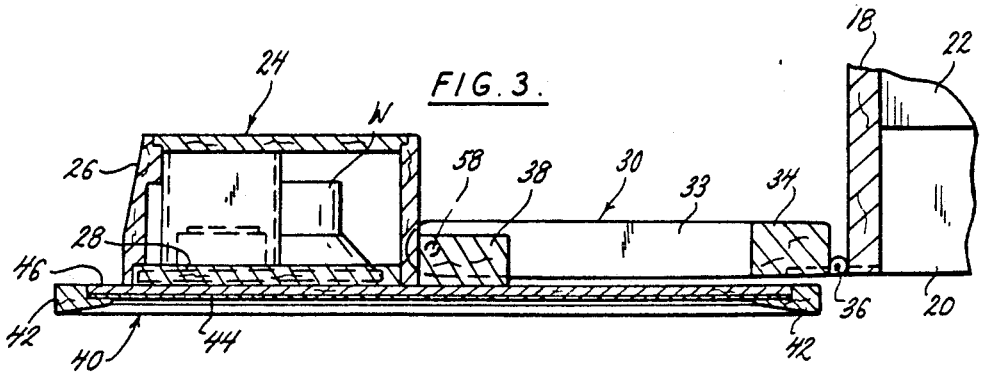

FIG. 4.
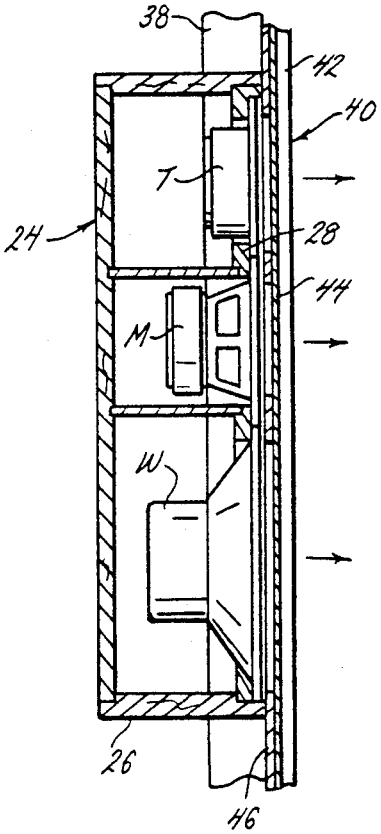
FIG. 5.
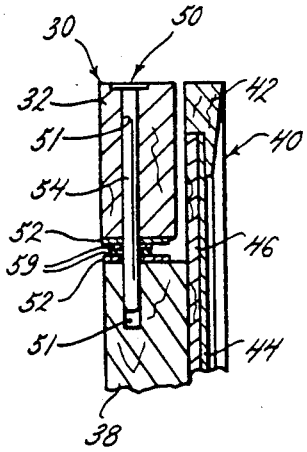
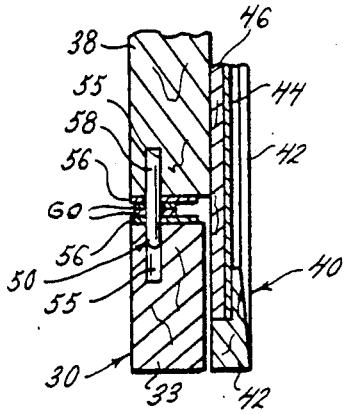
FIG. 6.
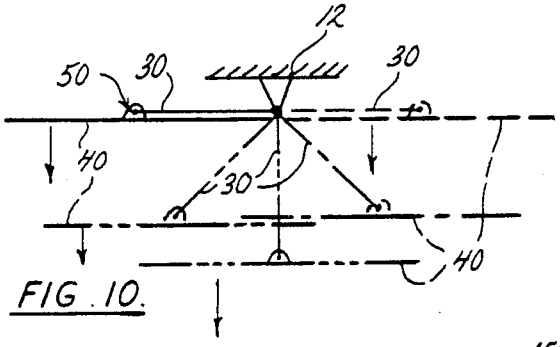
FIG. 10.
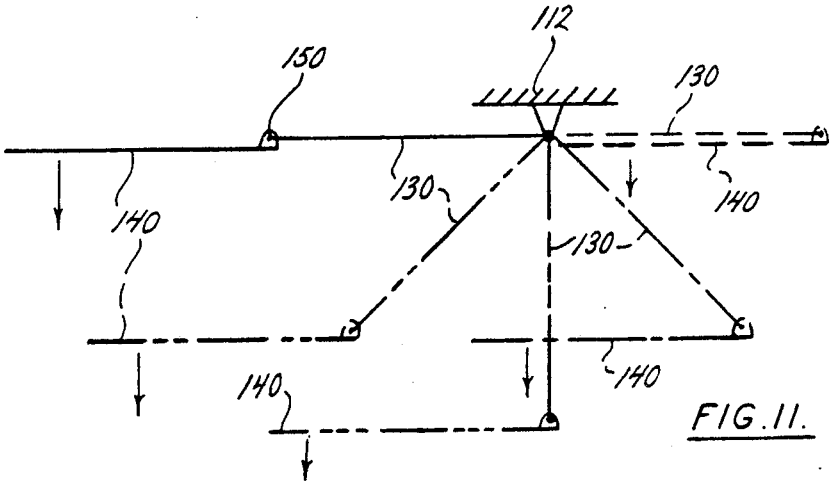
FIG. 11.

STEREO SYSTEM CABINET WITH LOUDSPEAKER DOOR ASSEMBLY

BACKGROUND OF THE INVENTION

This invention relates generally to stereo system cabinets and particularly to a cabinet having the loudspeakers mounted in the doors to provide speaker spacing greater than the width of the cabinet when the doors are in the open position.

It is well accepted by audiophiles that speaker systems are the greatest contributor to high fidelity sound in a stereo system. It is also accepted that for optimum listening pleasure the dual speaker systems used for stereo reproduction are most effective when laterally spaced from each other a distance between six and eight feet. From a practical standpoint this spacing is far too great to permit the speakers to be placed within the cabinet since such placement would result in an unacceptable cabinet width. For this reason it is common to find stereo systems having separate speaker enclosures at each side of the cabinet. While this permits the speakers to be spaced at a distance greater than the width of the cabinet it has the disadvantage of requiring two additional, and frequently large, objects as part of the room furniture.

Speakers which are attached to the stereo cabinet by extendible linkage, and which are stored within the rear of the cabinet when not in use, are shown in U.S. Pat. No. 3,680,936. However, these speakers are not mounted in cabinet doors and provide effective spacing only when the speakers are extended laterally outside of the width limits of the cabinet. A portable system is disclosed in U.S. Pat. No. 3,627,392 in which the speaker housings are hingedly attached to the cabinet but are effective only in the open position. The speakers are directed inwardly in the stored position. Dual hinged speaker housings are also disclosed in U.S. Pat. No. 3,572,866 in which the speaker housing is stored at the outside ends of the portable casing rather than inside the casing. The speakers are directed sideways in the stored position.

This stereo cabinet and loudspeaker door assembly overcomes the above problems in a manner not disclosed in the known prior art.

SUMMARY OF THE INVENTION

This cabinet for stereo systems provides folding door assemblies having built-in loudspeakers which face outwardly when the door assemblies are in the open and in the closed positions.

The door assemblies carrying the loudspeakers are movable into an open position to provide an optimum lateral spacing between the speakers greater than the width of the cabinet and this spacing can be achieved with both relatively wide and relatively narrow cabinets.

This stereo system cabinet and loudspeaker door assembly, comprises a cabinet body having opposed sides and an open front portion, and a door assembly including opposed mounting means operatively connected to the sides of the cabinet body and opposed loudspeaker panel means operatively connected to an associated mounting means, the loudspeaker panel means each including opposed sides defining a front portion, and the mounting means each including first pivot means swingingly connecting said mounting means to an associated side of said cabinet body for movement of said mounting means about a vertical axis between a closed position and an open position and a second pivot means swingingly connecting said panel means to said mounting means for movement about a vertical axis spaced from the vertical axis of said first pivot means whereby in the closed position with the front portion of the panel means being the outer portion of the door assembley, and facing outwardly without obstruction, and in the open position with the front portion of the panel facing outwardly, each panel means is laterally shifted, a distance substantially equal to twice the horizontal spacing between the first and second pivot means.

It is a feature of this invention to provide that each mounting means includes an upper arm portion and a lower arm portion and to provide a vertical strut pivotally connected between the upper and lower arm portions to provide the pivot means connecting the panel means to the mounting means.

It is a feature of this invention to provide a stereo cabinet and loudspeaker dual assembly which is relatively simple to manufacture and use and is very effective for its intended purpose.

BRIEF DESCRIPTION OF THE DRAWINGS

FIG. 1 is a front elevational view of the stereo system cabinet with one door in an open position and the other door in a closed position;

FIG. 2 view of the cabinet shown in FIG. 1.

FIG. 3 is an enlarged fragmentary sectional view taken on line 3—3 of FIG. 1.

FIG. 4 is an enlarged fragmentary sectional view taken on line 4—4 of FIG 1.

FIG. 5 is an enlarged fragmentary sectional view taken on line 5—5 of FIG. 1.

FIG. 6 is an enlarged fragmentary sectional view taken on line 6—6 of FIG. 1.

FIG. 10 is a schematic showing the movement of the door of FIG. 2, and

FIG. 11 is a schematic showing the movement of the door of FIG. 9.

DESCRIPTION OF THE PREFERRED EMBODIMENT

Figures 7, 8, 9:
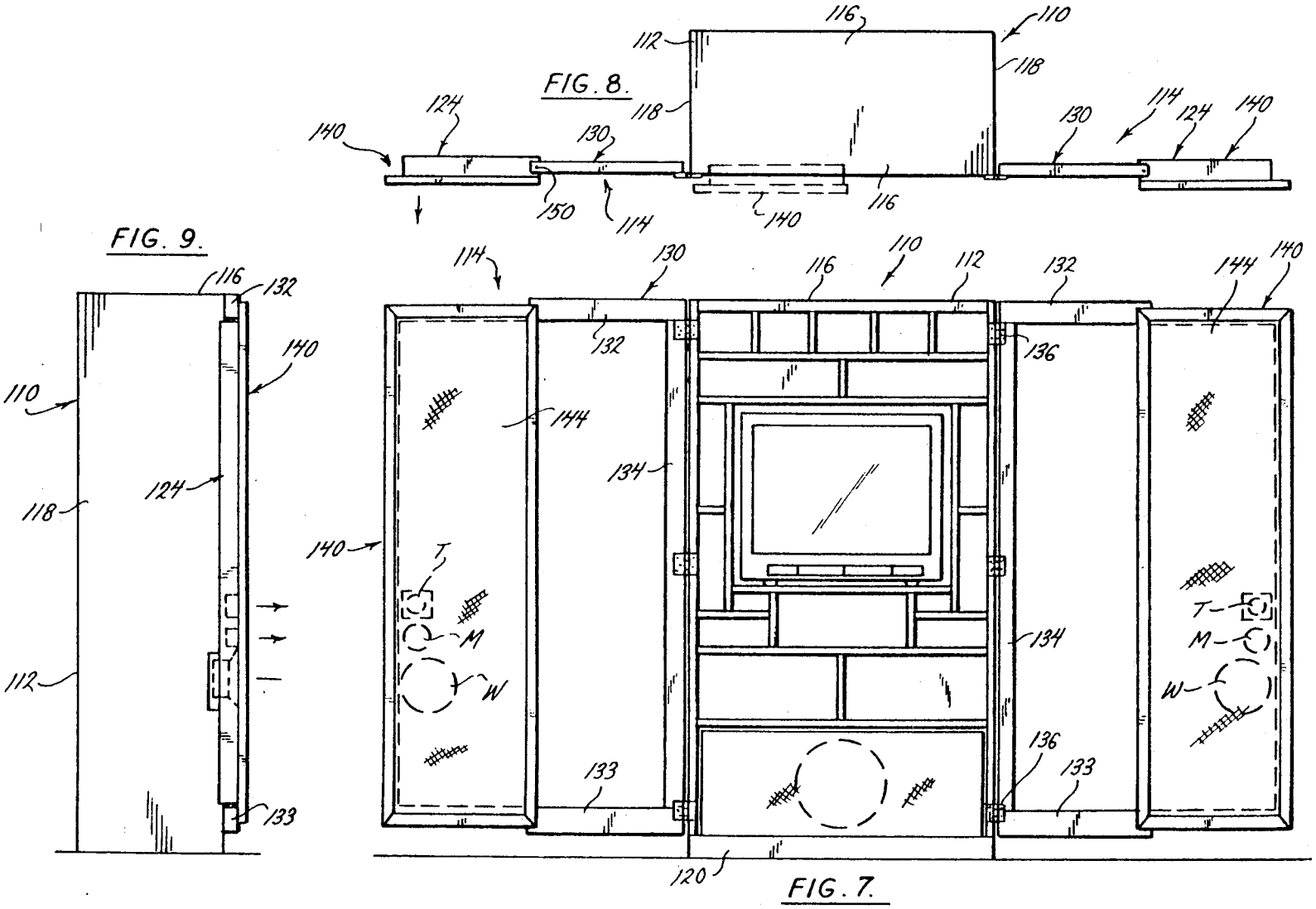
FIG. 7 is a front elevational view of a stereo system cabinet having a modified door construction with both doors in the open position.
FIG. 8 is a plan view of the cabinet shown in FIG. 7.
FIG. 9 a side elevational view of the cabinet shown in FIG. 7.

Referring now by reference numerals to the drawings and first to FIGS. 1 and 2 it will be understood that the stereo system cabinet 10 includes a cabinet body 12 having opposed wing door assemblies 14 constructed in mirror-image of each other. The door assemblies 14 are movable between a closed position, as shown by the right-hand door, and an open position, as shown by the left-hand door. The doors assemblies 14, in the embodiment shown, are identical except for the mirror-image construction. Accordingly, it will be understood that identical parts are represented by the same reference numeral.

The cabinet 12 includes upper and lower members 16 and 20 interconnected by vertical side members 18 and is subdivided into various compartments by shelving, generally indicated by numeral 22, which is arranged to accommodate various stereo components such as a receiver, a tape deck and a disc player which are not specifically shown. The central compartment can house a television set and other compartments can be used for cassette tape, disc and phonograph record storage. The loudspeaker assembly consists of two sets of speakers which, in the embodiment shown in FIG. are conveniently carried by enclosures 24 mounted to each door assembly 14, as will be described below.

Each door assembly 14, in the embodiment shown in FIGS. 1-3, includes a generally U-shaped mounting frame 30 having upper and lower opposed arms 32 and 33 and an elongate vertical bight member 34. The mounting frame 30 is pivotally attached to the cabinet body side members 20, as by a set of butt hinges 36 constituting a first pivot means. A vertical mounting strut 38 extends between, and is pivotally connected to, the upper and lower arms 32 and 33. Attached to this strut 38, is a loudspeaker grille panel 40 and the loudspeaker enclosure 24. The loudspeaker panel 40 includes a frame 42, a grille 44 and a back plate 46 which is attached to the strut 38 as by screws (not shown). In the embodiment shown, the loudspeaker enclosure 24 includes a box-like rear portion 26 and an apertured front plate 28 to which are attached the components of a loudspeaker set which includes typically tweeter, mid-range and woofer loudspeakers indicated by and respectively. The loudspeaker grille back plate 46 is provided with openings in register with said speakers and W. In the embodiment shown, see FIG. 3, the loudspeaker enclosure 24 is attached to the strut 38 at the desired height. Preferably, the speakers are located on the outer side of the strut 38.

The strut 38 is removably pivotally mounted to the mounting frame arms 32 and 33, as best shown in FIGS. 5 and 6, by pivot means 50 to provide independent swinging of the panel to a desired position to suit the listener. The upper portion of the pivot means 50 includes a bore 51 in the upper arm 32, bearing plates 52 attached to the underside of said arm 32 and the top of the strut 38, a bore 53 in the strut 38 and a removable pin 54 extending between said bores 51 and 53. Bearing washers 59 are disposed between the bearing plates 52. The lower portion of the pivot means 50 includes a bore 55 in the lower arm 33, bearing plates 56 attached to the upper side of said arm 33 and the bottom of the strut 38, a bore 57 in the strut 38 and a removable pin 58 extending between said bores 55 and 57. Bearing washers 60 are disposed between the bearing plates 56.

The use of upper and lower bearing plates 52 and 56, which can be of a desired thickness, provides flexibility of alignment adjustment of the cabinet components. Also, the choice of the material of the bearing washers 60 conditions the braking friction of the pivotal connection between the strut 38 and the mounting frame 30. Finally, as best shown in FIG. 3, the vertical axis of the pivot means 50, in the embodiment shown, is off-center to increase the available width for the speaker enclosure 24. This structural arrangement of parts provides that the strut 38, and therefore the loudspeaker enclosure 24 attached to said strut, is pivotable relative to said mounting frame 30. In addition, and importantly, the mounting frame 30 is pivotable relative to the cabinet body 12, thereby providing the loudspeaker panel with compound pivotal movement relative to the cabinet body 12. This advantageous structural arrangement of parts permits the loudspeaker panel 40 to be unfolded to the open position and refolded into the closed position while facing to the front in all positions in between.

The compound pivotal nature of the panel 40 relative to the cabinet body 12 is shown schematically in FIG. 10. As shown, loudspeaker panel 40 is swingingly mounted to the mounting frame 30 so that as the frame 30 is swung through one hundred eighty-degrees between an open and closed door position, the front of the loudspeaker panel 40, whence the sound issues from the loudspeakers, is maintained in a direction pointing generally toward the listener in both the open and closed door positons. Additionally, if desired, the loudspeaker panel can be rotated into a specific direction toward the listener in the open or partially open door position. In effect, the sound from the speakers is projected outwardly, as shown by the arrows in FIGS. 2, 3 and 10, when the cabinet doors assemblies 14 are in the closed as well as in the open position and also in between these positions.

As clearly shown in FIGS. 1 and 2, the panel 40 is substantially one half of the width of the cabinet body open front portion in the preferred embodiment. Although, in the embodiment shown in FIGS. 1-3, loudspeaker panel 40 has upper and side edges in register with the mounting frame 30, the loudspeaker panel 40 can if desired be disposed inwardly of the limits of the mounting frame 30 so that in the closed position as well as in the open position the mounting frame 30 provides an attractive framing edge as shown in phantom outline by 40' in FIG. 1. In addition this arrangement, by engagement of the loudspeaker frame 40 with the mounting frame 30, provides a stop preventing unlimited counter-rotational movement of said loudspeaker panel.

It will be understood from FIG. 10, that each of the door assemblies 14 has a maximum lateral shift of twice the horizontal distance between the vertical axis of the first pivot means 36, between the mounting frame 30 and the cabinet body 12, and the vertical axis of the second pivot means 50, between the loudspeaker panel 40 and the mounting frame 30.

In the embodiment shown in FIGS. 1, 3 and lo the radial distance between the first and second vertical pivot means 36 and 50 is about one half of the width of the loudspeaker grille panel 40. This arrangement provides that the inner edge of each panel 40 is substantially aligned with the cabinet side in the open position. However, the distance between the first and second pivot axes can be greater or less than this. When the distance between the pivot means is less than one-half of the panel width, the panel 40 will overlap the cabinet 10 in the open position. When the distance between the pivot means is greater than one-half of the panel width, the panel 40 will be spaced from the cabinet 10. Thus, the horizontal radial spacing of the first and second vertical axes can be chosen to suit the desired spacing of the speaker enclosures 24 independently of the width of the cabinet 10, a spacing of between six to eight feet center to center being preferred. The offset location of vertical axis of the pivot means 50 relative to the axis of the strut 38 also conditions spacing of the speaker enclosures 24.

A modified stereo system cabinet is shown in FIGS. 7-9 and 11. For convenience, corresponding parts are given similar numbers to those of the embodiment discussed above with the addition of suffix numeral "1".

The cabinet 110 is similar to the cabinet 10 described above but the door assemblies 114 are different in that the mounting frame 130 upper and lower arms 132 and 133 extend outwardly from the vertical connecting member 134 a distance approximately one-half of the width of the cabinet body 112 so that in the open position the loudspeaker panels 140 and the loudspeakers are disposed outwardly from the cabinet side members 120 a greater distance than is the case with the first described embodiment. The result of this arrangement is that the cabinet 110 can be narrower than the cabinet 10 and yet the optimum lateral spacing of the speakers can be achieved. In the modified door assembly 114 the loudspeaker enclosure 124 has sufficient height that it can be pivoted directly to the upper and lower arms 132 and 133 of the mounting frame 130 by pivot means similar to those shown in FIGS. 5 and 6. As with the embodiment already described each of the door assemblies 114 has a maximum lateral shift of twice the horizontal distance between the first and second pivot means.

The systems described above provide versatile loudspeaker panel positioning and speaker spacing which can be varied within a considerable range, depending on the horizontal spacing of the pivot axis of the loudspeaker panel from the cabinet body, in order to provide a substantially constant optimum spacing between the opposed speaker assemblies in the open or partly open position. The first embodiment is suitable for wide cabinets while the second is suitable for narrower cabinets. In each case, the speakers are spaced for optimum stereo listening. Variations of the loudspeaker panel pivot location relative to the mounting frame pivot location can be made so that the optimum speaker spacing can be achieved to a large extent independently of the width of the cabinet housing the other stereo components. In addition, satisfactory stereo sound projection is available even when the door assemblies are fully closed.

Accordingly, it will be understood that various aspects and features of the invention are achieved and other advantageous results are attained. While preferred embodiments of the invention have been shown and described, it will be clear to those skilled in the art that various modifications may be made without departing from the invention in its broader aspect.

I claim as my invention:

1. A stereo system cabinet and loudspeaker door assembly, comprising:

(a) a cabinet body having opposed sides and an open front portion, and (b) a door assembly including opposed mounting means each operatively connected to a side of the cabinet body, each mounting means being generally U-shaped and including an upper arm portion, a lower arm portion and a vertical bight portion interconnecting said upper and lower arm portions, and opposed loudspeaker panel means operatively connected to an associated mounting means, the loudspeaker panel means each including opposed sides defining a front portion and the mounting means each including first pivot means swingingly connecting said mounting means bight portion to an associated side of said cabinet body for movement of said mounting means about a vertical axis between a closed position and an open position and a second pivot means swingingly connecting said panel means to said mounting means are portions, for movement about a vertical axis spaced from the vertical axis of said first pivot means whereby in the closed position, with the front portion of the panel means being an outer portion of the door assembley and facing outwardly without obstruction and in the open position, with the front portion of the panel means facing outwardly, each panel means is laterally shifted a distance substantially equal to twice the horizontal spacing between the first and second pivot means.

2. A cabinet and loudspeaker door assembly as defined in claim 1, in which:

(c) a vertical strut extending between said upper and lower arm portions is pivotally connected to the upper and lower arm portions to provide the second pivot means connecting the panel means to the mounting means.

3. A cabinet and loudspeaker assembly as defined in claim 1, in which:

(c) the second pivot means is disposed intermediate the opposed sides of the panel means.

4. A cabinet and loudspeaker assembly as defined in claim 1, in which:

(c) the second pivot means is disposed substantially midway between the opposed sides of the panel means.

5. A cabinet and loudspeaker assembly as defined in claim 1, in which:

(c) the second pivot means is disposed substantially at an inner side of the panel means.

6. A cabinet and loudspeaker assembly as defined in claim 2, in which:

(d) the loudspeaker panel means, includes a loudspeaker enclosure attached to the strut at a selectively positioned vertical height convenient to the listener.

7. A cabinet and loudspeaker assembly as defined in claim 6, in which:

(e) the cabinet body includes shelving and said shelving is relatively recessed in a vicinity of the loudspeaker enclosure to accommodate said enclosure in the closed position.

8. A cabinet and loudspeaker assembly as defined in claim 2, in which:

(c) the first pivot means is provided by butt hinges between the vertical bight portion and sides of the cabinet body and the second pivot means is provided by pivot pins extending between the arm portions and the strut.

9. A cabinet and loudspeaker door assembly as defined in claim 1, in which:

(c) each loudspeaker panel means has a width substantially one half of the cabinet body open front portion.

10. A cabinet and loudspeaker door assembly as defined in claim 2, in which:

(d) the vertical strut includes a vertical axis and the second pivot means is offset from said axis.

11. A cabinet and loudspeaker door assembly as defined in claim 6 in which:

(e) the loudspeaker enclosure is disposed between the strut and an outer side of the panel means.

12. A stereo system cabinet and loudspeaker door assembly, comprising:

(a) a cabinet body having opposed sides and an open front portion, and (b) a door assembly including opposed mounting means each operatively connected to a side of the cabinet body, each mounting means being generally U-shaped and including an upper arm portion, a lower arm portion and a vertical bight portion interconnecting said upper and lower arm portions, and opposed loudspeaker panel means operatively connected to an associated mounting means, the loudspeaker panel means each including opposed sides defining a front portion and the mounting means each including first pivot means swingingly connecting said mounting means bight portion to an associated side of said cabinet body for movement of said mounting means about a vertical axis between a closed position and an open position of the door assembly and a second pivot means swingingly connecting said panel means to said mounting means arm portions, for movement of the panel means independently of the mounting means about a vertical axis spaced from the vertical axis of said first pivot means whereby in the closed position, the front portion of the panel means, with the panel means being an outer portion of the door assembley, faces outwardly without obstruction, and in the open position, each panel means is selectively rotatable so that the front portion of the panel means faces in a direction to suit the listener.

* * * * *